US007592966B2

(12) United States Patent
Tsai et al.

(10) Patent No.: US 7,592,966 B2
(45) Date of Patent: Sep. 22, 2009

(54) BROADBAND ANTENNA AND ASSEMBLY COMBINATION THEREOF

(75) Inventors: Feng-Chi Eddie Tsai, Taipei Hsien (TW); Chih-Ming Wang, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 331 days.

(21) Appl. No.: 11/604,783

(22) Filed: Nov. 28, 2006

(65) Prior Publication Data

US 2007/0279291 A1 Dec. 6, 2007

(30) Foreign Application Priority Data

Jun. 2, 2006 (TW) ..... 95209640 U

(51) Int. Cl.
*H01Q 1/38* (2006.01)

(52) U.S. Cl. ..... 343/828; 343/795; 343/830; 343/834

(58) Field of Classification Search ..... 343/700 MS, 343/795, 828–830, 834, 846
See application file for complete search history.

(56) References Cited

U.S. PATENT DOCUMENTS 6,008,773 A * 12/1999 Matsuoka et al. ..... 343/818

* cited by examiner

*Primary Examiner*—Michael C Wimer
(74) *Attorney, Agent, or Firm*—Bacon & Thomas, PLLC

(57) ABSTRACT

A broadband antenna and an assembly combination thereof are disclosed. The broadband antenna according to the present invention comprises a first radiation element, a second radiation element, a substrate, and a reflector. The first radiation element having a first trapezoid portion and the second radiation element are disposed on the substrate that is fixed on the reflector. The first radiation element and the second radiation element are excited so as to reflect the energy by the radiator.

28 Claims, 17 Drawing Sheets

2.5 GHz E plane

5.25 GHz E plane

BROADBAND ANTENNA AND ASSEMBLY COMBINATION THEREOF

FIELD OF THE INVENTION

The present invention relates to a broadband antenna, especially to a compact broadband antenna and an assembly combination thereof.

DESCRIPTION OF RELATED ART

Due to system integration for wireless communication is in progress, the broadband antenna has been an essential requirement for communication systems.

Conventionally, a discone antenna of the broadband antenna has been disclosed. Refer to U.S. Pat. No. 4,851,859, the discone antenna provides optimal performance at microwave frequencies. Though, the conventional discone antenna can receive signals in broadband, its structure is not only too large but also quite heavy. It's not practical and not able to meet requirements of compact size and light weight as desired for the market.

Moreover, the structure of the conventional antenna is shaped in conical, and the desired radiation pattern can't be controlled according to such structure.

In order to solve above problems, the present invention provides a broadband antenna and an assembly combination thereof.

SUMMARY OF THE INVENTION

It is a primary objective of the present invention to provide a compact broadband antenna. Another objective of the present invention is to provide a broadband antenna assembly combination that includes at least two antennas. Further objective of the present invention is to provide a broadband antenna and a broadband antenna assembly combination that both are able to control the radiation pattern.

An embodiment of the broadband antenna according to the present invention includes a first radiation element, a second radiation element, a substrate, and a reflector. The first radiation element comprising a first trapezoid portion. The first radiation element and the second radiation element are disposed on the substrate.

The first radiation element further comprises a second trapezoid portion, and the first trapezoid portion and the second trapezoid portion connect with each other to form an integral. Both the first trapezoid portion and the second trapezoid portion have an upper base and a lower base, and the length of the lower base of the first trapezoid portion is substantially equal to that of the upper base of the second trapezoid portion. Moreover, the length of the lower base of the second trapezoid portion is larger than that of the lower base of the first trapezoid portion.

It is preferable that the distance between the first radiation element and the second radiation element is smaller than or substantially equal to 5 mm while the distance between the first radiation element and a soldering part is larger than or substantially equal to 0.3 mm. In an embodiment, the substrate is arranged perpendicular to the reflector. In another embodiment, the substrate and the reflector may be on the same plane. The first radiation element and the second radiation element are excited so as to reflect the energy by the radiator.

The first trapezoid portion of the first radiation element is an isosceles trapezoid with congruent legs and an angle formed by an intersection of the two legs of the first trapezoid portion ranges substantially from 50 to 80 degrees.

Furthermore, the second trapezoid portion of the first radiation element is also an isosceles trapezoid with congruent legs. In the first trapezoid portion, the absolute values of slopes of the two legs are the same and are larger than or substantially equal to that of the second trapezoid portion.

It is preferable that the length of the second radiation element is larger than or equal to ¼ wavelength of the center frequency at low frequency band, and the width of the second radiation element is smaller than or substantially equal to 1/16 wavelength of the center frequency at low frequency band.

In another embodiment of the present invention, the second radiation element comprises a first part, a second part, and a connecting part that connects the first part and the second part. The first part is n-shaped and the width of the first part is smaller than or substantially equal to 1/16 wavelength of center frequency at the low frequency band. The midpoint of the second part of the second radiation element is a feeding point for current.

The total length of the first part and the second part is about ¼ wavelength of the center frequency at low frequency band while the length of the second part is substantially ¼ wavelength of the center frequency at high frequency band.

In a further embodiment of the present invention, the first radiation element includes an upper base, a lower base, and two legs, wherein the lower base has an opening. It is preferable that a length of the upper base is substantially about ¼ wavelength of the center frequency at high frequency band. The width of the two legs of the first radiation element substantially ranges from 1/16 to ⅛ of the length of lower base. Also, the length of the opening is substantially about 1/16 to ⅛ of the length of lower base.

In addition, the present invention also provides a broadband antenna assembly combination comprising a first antenna, a second antenna, a radiation plate, and a reflector.

The first antenna and/or the second antenna may utilize the first radiation element and substrate mentioned above, and the first antenna and the second antenna intersect with each other at an angle such as 90 degrees. The radiation plate is perpendicular to both of the first antenna and the second antenna. Moreover, the radiation plate includes a first side, a second side, a third radiation element disposed on the first side, and a fourth radiation element disposed on the second side. By current passing through the first antenna, the second antenna, and the radiation plate, radiation energy is excited and then reflected by the reflector.

Other objectives, advantages, and novel features of the invention will become more apparent from the following detailed description when taken in conjunction with the accompanying drawings.

BRIEF DESCRIPTION OF THE DRAWINGS

These and other features, aspects, and advantages of the present invention will become better understood with regard to the following description, appended claims, and accompanying drawings, in which:

DETAILED DESCRIPTION OF THE PREFERRED EMBODIMENTS

Figure 1A:
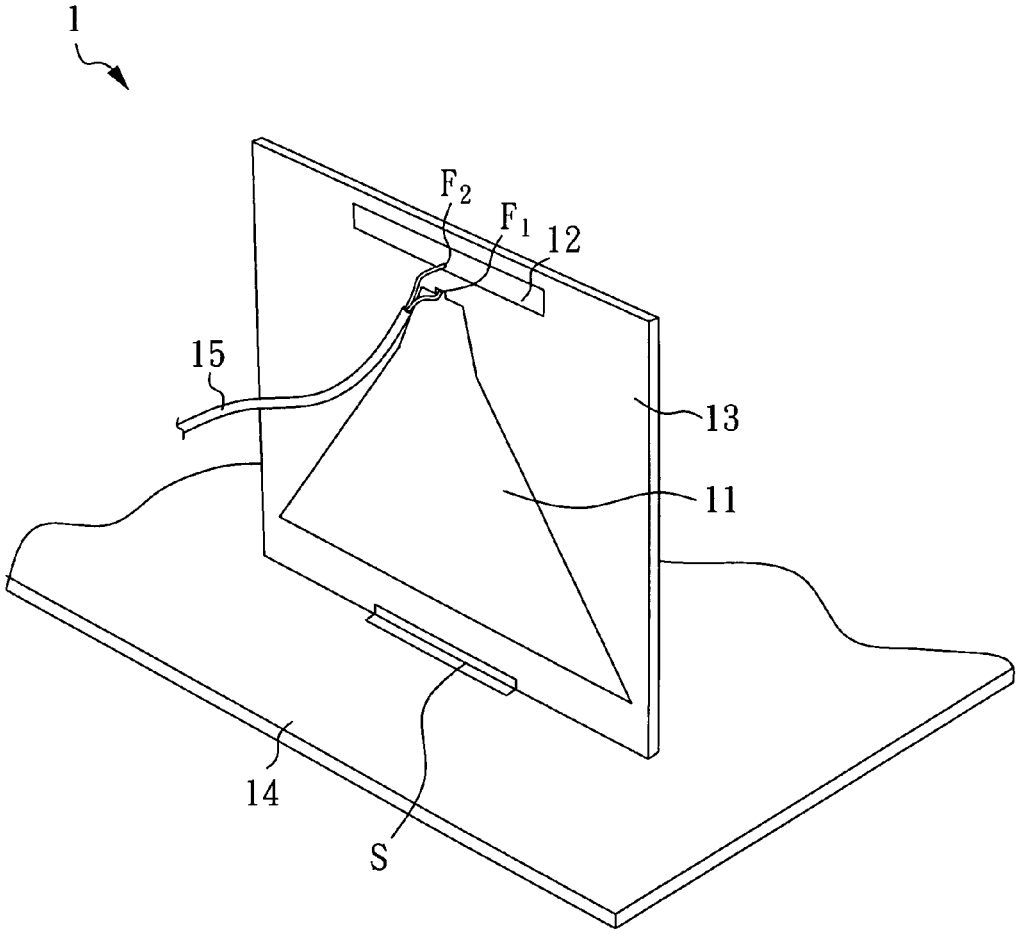
FIG. 1A is a perspective view of a broadband antenna of an embodiment in accordance with the present invention.
Figure 1B:
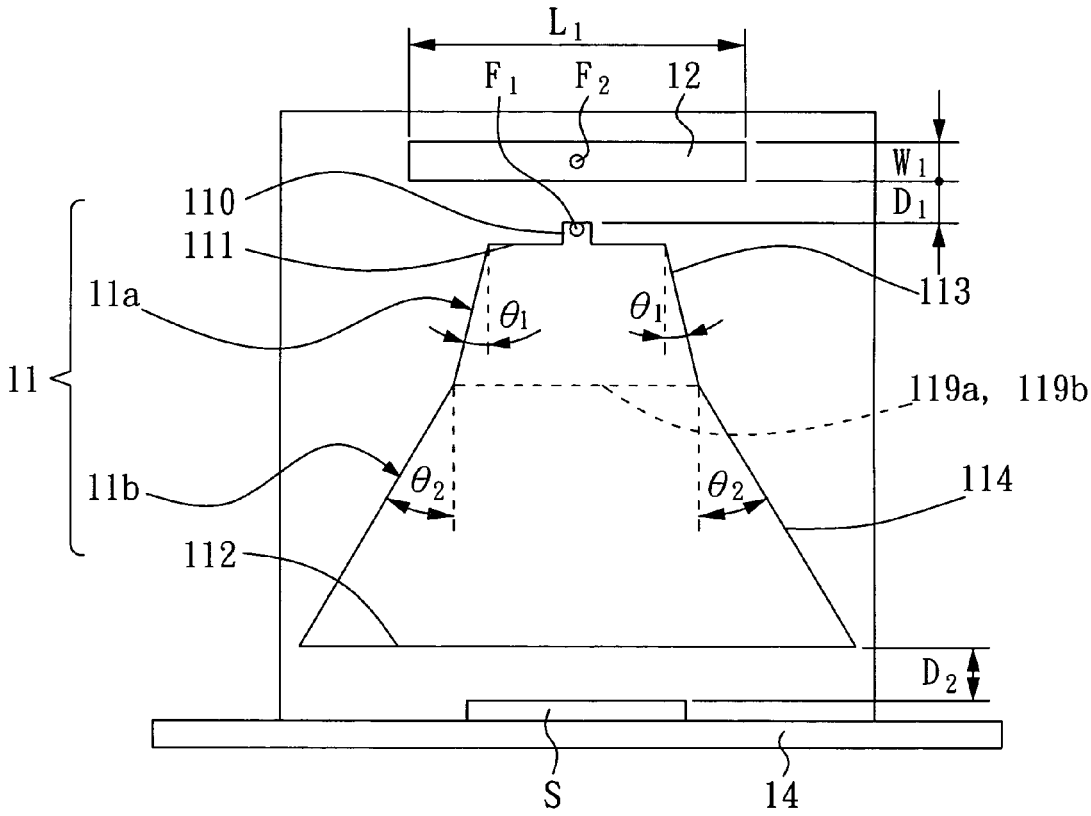
FIG. 1B is a front view of a broadband antenna of an embodiment in accordance with the present invention.

The present invention discloses a broadband antenna and an assembly combination thereof. Referring to FIG. 1A and FIG. 1B of a perspective view and a front view of a broadband antenna of an embodiment, a broadband antenna 1 according to the present invention comprises a first radiation element 11, a second radiation element 12, a substrate 13, and a reflector 14. The first radiation element 11 comprises a first trapezoid portion 11*a* and a second trapezoid portion 11*b* that connected with each other to form an integral. The first trapezoid portion 11*a* and the second trapezoid portion 11*b* have an upper base 111, 119*b* and a lower base 119*a*, 112 respectively. The length of the lower base 119*a* of the first trapezoid portion 11*a* is substantially equal to that of the upper base 119*b* of the second trapezoid portion 11*b*. In this embodiment, the second radiation element 12 is shaped in string while it can be varied in other embodiment. Moreover, the first radiation element 11 can also be varied in different arrangements, which will be described more detail in below.

The first radiation element 11 and second radiation element 12 are preferred to be disposed on the substrate 13. In a preferred embodiment, the distance D1 between the first radiation element 11 and the second radiation element 12 is smaller than or substantially equal to 5 mm.

Figure 1C:
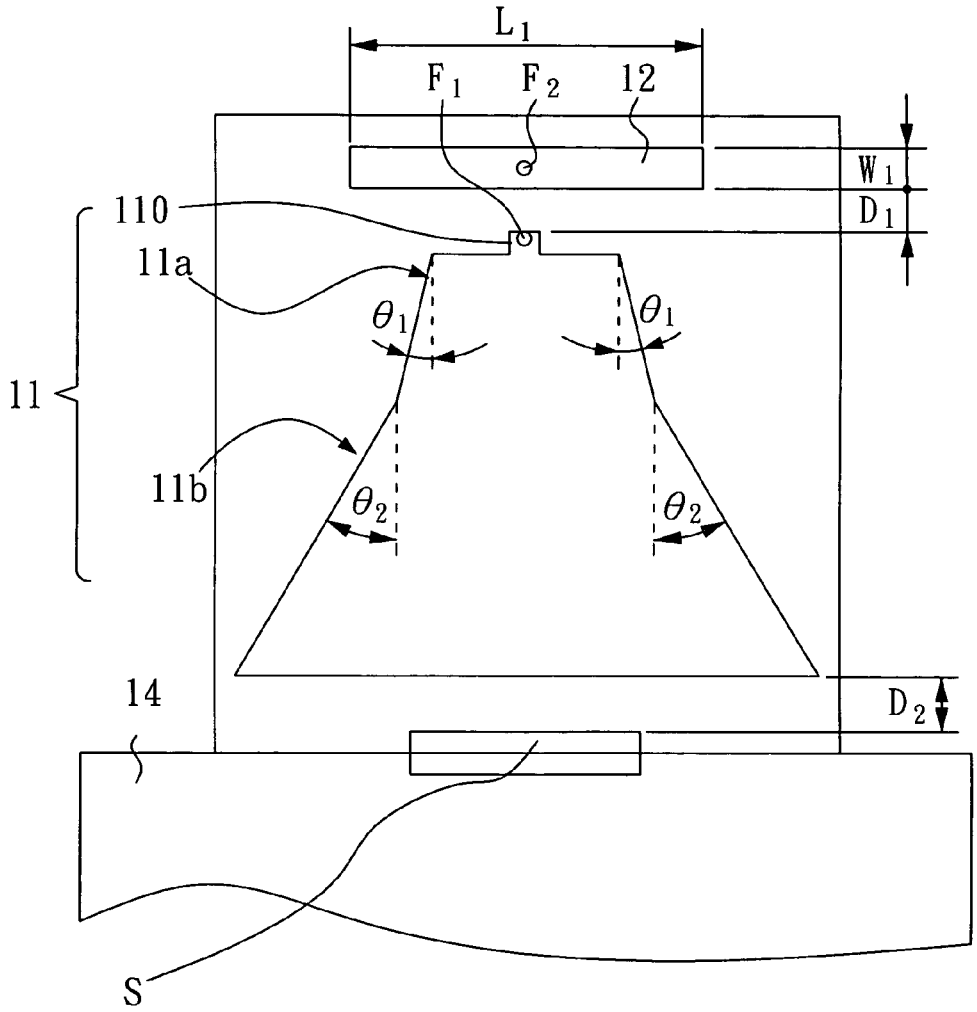
FIG. 1C is a broadband antenna of an embodiment in accordance with the present invention with a first radiation element and a reflector arranged on the same plane.

The reflector 14 and the substrate 13 are secured with each other. For example, a soldering part S can be used to connect and fix the substrate 13 with the reflector 14. It is preferably that distance D2 between the first radiation element 11 and the soldering part S is larger than or substantially equal to 0.3 mm. In this embodiment, the substrate 13 is arranged perpendicular to the reflector 14, while in other embodiment, the substrate 13 and the reflector 14 may, for example, lie on the same plane, as shown in FIG. 1C. The first radiation element 11 and the second radiation element 12 radiate energy by current passing through, the reflector 14 reflects the radiation energy to generate the radiation pattern for signal transmission of the broadband antenna 1.

The reflector 14 can be a metal plate or a metal layer coated on the substrate 13. As skilled in the present art will be appreciated, there is no limitation on shape or material for the reflector 14 shown in Figs.

It is preferable that the first radiation element 11 and the second radiation element 12 respectively include a first feeding point F1 and a second feeding point F2. The first feeding point F1 is located at the midpoint of a upper base 111 of the first trapezoid portion 11*a* on the first radiation element 11 while the second feeding point F2 is at the midpoint of the second radiation element 12.

The first radiation element 11 having a feeding part 110 that projects a bit beyond the upper base 111 of the first trapezoid portion 11*a*. It is preferable that the first feeding point F1 is located at the feeding part 110.

In this embodiment, an angle formed by an intersection of two legs 113 on the first trapezoid portion 11*a* of the first radiation element 11 substantially ranges from 50 to 80 degrees. In other words, the angle θ1, in FIG. 1B, substantially ranges from 25 to 40 degrees.

It is preferable that, in the first trapezoid portion 11*a*, the absolute vales of the slopes of the two legs 113 are the same and larger than or substantially equal to that of the two legs 114 of the second trapezoid portion 11*b*. For example, the slope is larger than or substantially equal to 0 to 20 degrees. That means the angle θ2 is larger than the angle θ1 substantially about 0 to 20 degrees.

One of the key points of the present invention is in the shape of the first radiation element 11. That is, it is about the slope of the two legs 113 of the first trapezoid portion 11*a* and the slope of the two legs 114 of the first trapezoid portion 11*b*. Although in the embodiment mentioned above and below, the trapezoid shape is taken as an example, there is no limitation on that shape. For example, the upper base 111 of the first trapezoid portion 11*a* and the lower base 112 of the second trapezoid portion 11*b* may be parallel with each other or not. Moreover, the upper base 111 and/or the lower base 112 may not be a linear line.

The length L1 of the second radiation element 12 is larger than or substantially equal to ¼ wavelength at the lower operating frequency such as the center frequency at the low frequency band. The width W1 of the second radiation element 12 is smaller than or substantially equal to 1/16 wavelength of the center frequency at low frequency band.

The substrate 13 can be a non-conducting substrate or a multilayer circuit board. Once the substrate is a non-conducting substrate, the broadband antenna 1 further includes a coaxial cable 15 that electrically connects with the first radiation element 11 and the second radiation element 12 for feeding current. For example, the first feeding point F1 can be a positive electrode while the second feeding point F2 is a negative electrode or vice versa so as to make the first radiation element 11 and the second radiation element 12 radiate energy through current excitation.

If the substrate 13 is a multilayer circuit board, there is no need to use the coaxial cable 15 for feeding current. By means of circuit design in the multilayer, the first radiation element 11 and the second radiation element 12 are electrically connected with each other. For example, the first radiation element 11 and the second radiation element 12 can be located on different layers of the circuit board respectively. Thus the alternating current is fed into the first radiation element 11 and the second radiation element 12 for radiating energy.

Figure 2A:
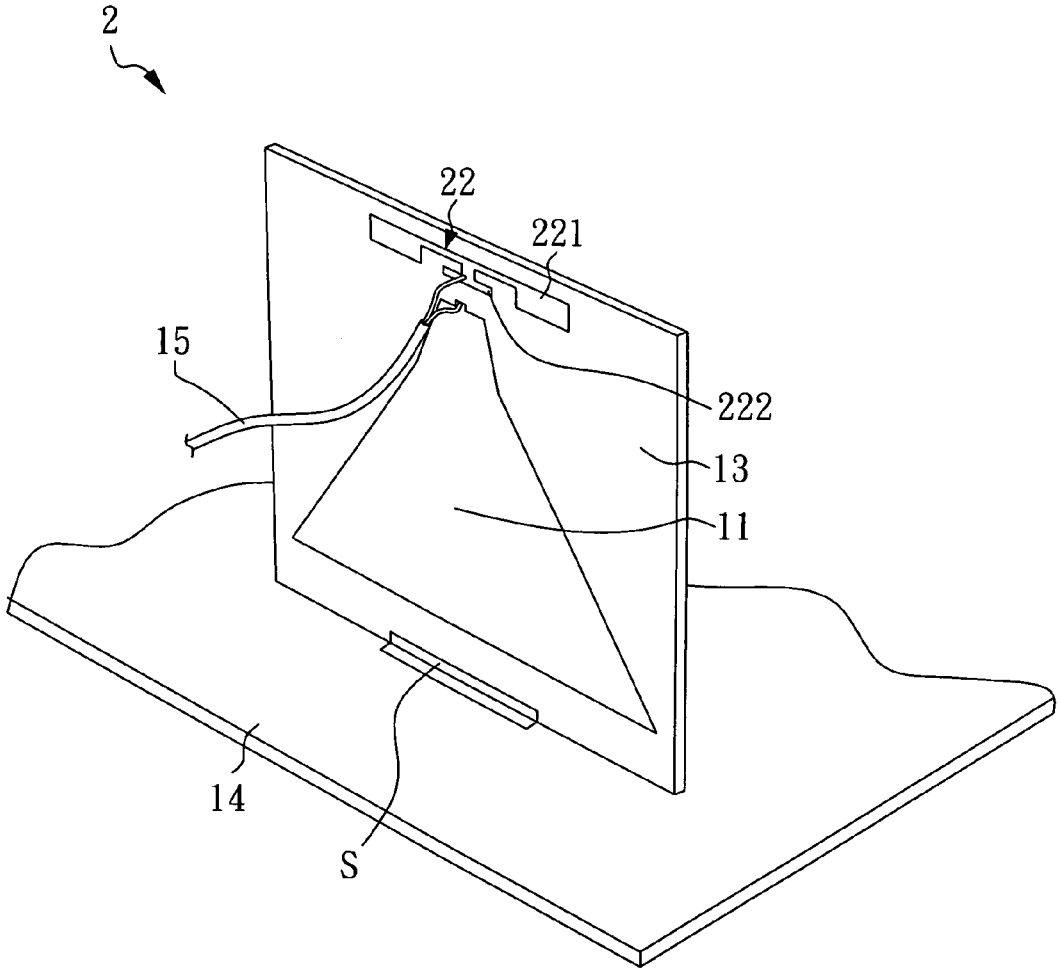
FIG. 2A and FIG. 2B respectively show a perspective view and a front view of a broadband antenna of another embodiment in accordance with the present invention.
Figure 2B:
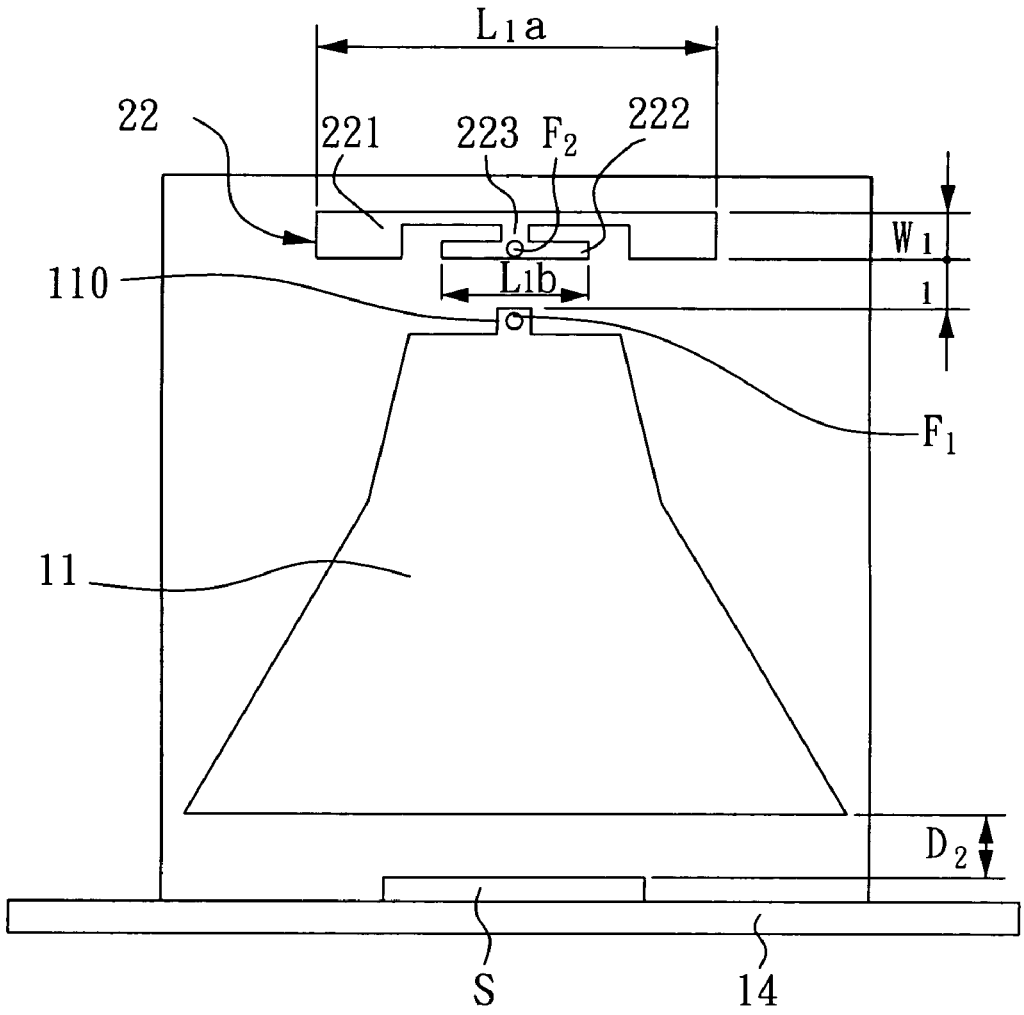

FIG. 2A and FIG. 2B showing a perspective view and a front view of a broadband antenna of another embodiment in accordance with the present invention respectively. The second radiation element 12 disclosed in FIG. 2A differs from that in FIG. 1A. In order to reduce the size of the broadband antenna, a second radiation element 22 of a broadband antenna 2 includes a first part 221, a second part 222, and a connecting part 223 that connects the first part 221 and the second part 222. The first part 221 is in n-shaped and the width W1 of the first part 221 is smaller than or substantially equal to 1/16 wavelength of the center frequency at low frequency band. Moreover, the width W1 of the second radiation element 22 in FIG. 2B is substantially equal to that of the second radiation element 12 in FIG. 1B. The midpoint of the second part 222 of the second radiation element 22 is a feeding point for current.

In this embodiment, the total length of the first part 221 and the second part 222, L1*a* plus L1*b*, is about 1/4 wavelength of the center frequency at low frequency band, and the length L1*b* of the second part 222 is about 1/4 wavelength of the center frequency at high frequency band. Thus the size of the second radiation element 22 is minimized so that the volume of the broadband antenna 2 can be reduced notably.

Figure 3A:
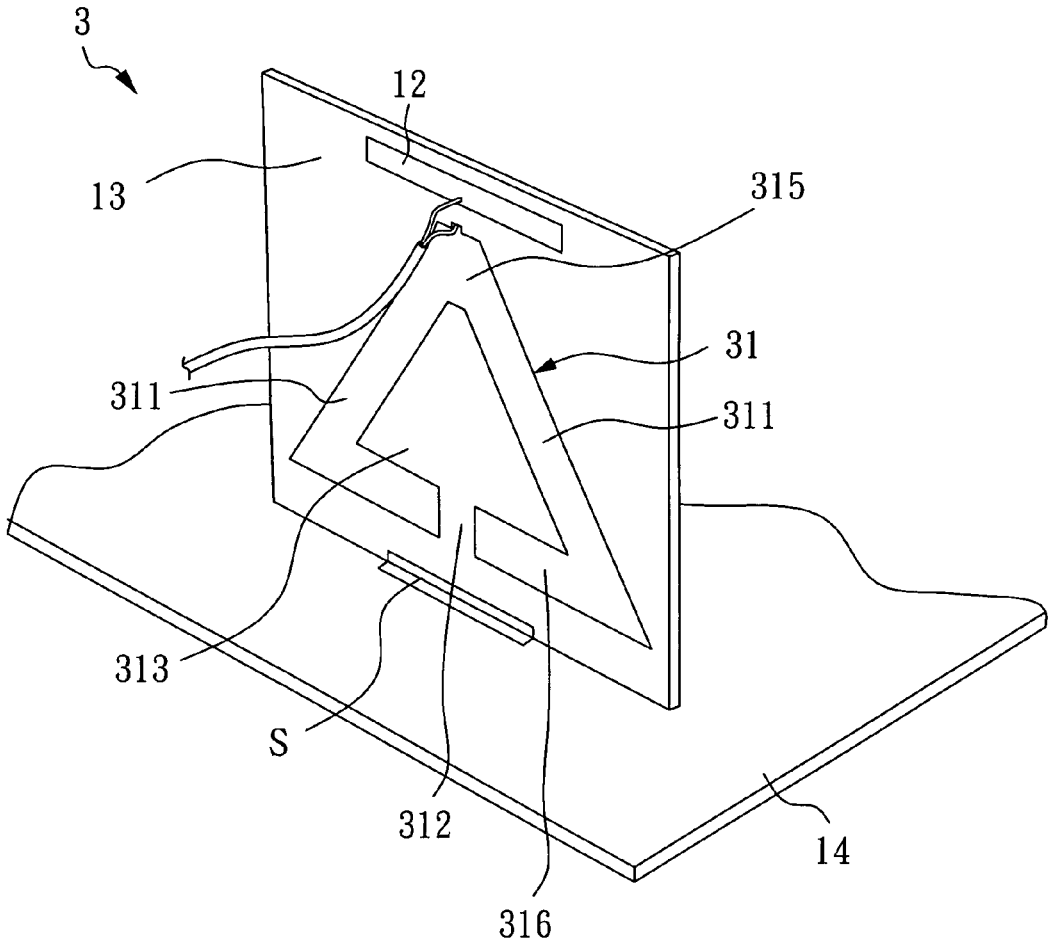
FIG. 3A and FIG. 3B respectively show a perspective view and a front view of a broadband antenna of a further embodiment in accordance with the present invention.
Figure 3B:
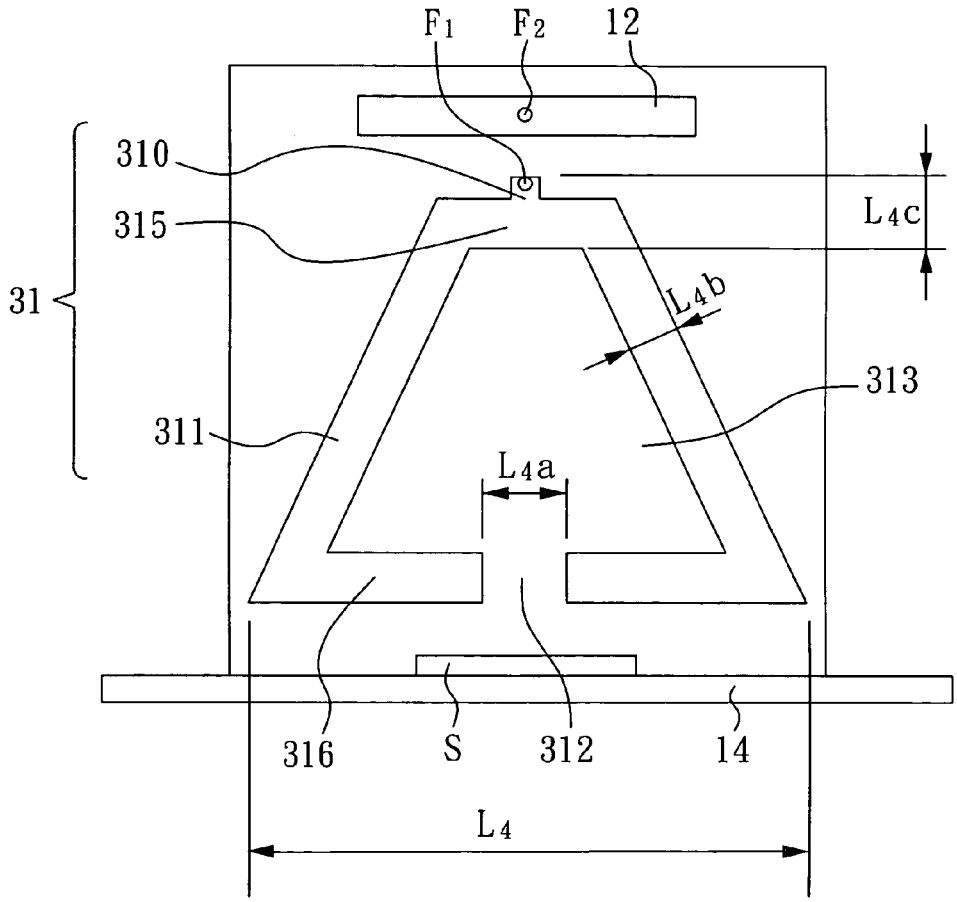

Referring to FIG. 3A and FIG. 3B, which show a perspective view and a front view of a broadband antenna of a further embodiment in accordance with the present invention respectively. A first radiation element 31 of a broadband antenna 3 includes an upper base part 315, a lower base part 316, and two legs 311 that connect the upper base part 315 and the lower base part 316 thereby a hollowed area 313 is formed therein.

The first radiation element 31 comprises a feeding part 310 that projects a bit over beyond the upper base 315. The lower base 316 includes an opening 312 that connects with the hollow area 313.

It is preferable that length L4*c* of the upper base 315 is about 1/4 of the wavelength at high frequency band. The length L4*b* of two legs 311 of the first radiation element 31 ranges substantially from 1/16 to 1/8 length L4 of the lower base 316. And the length L4*a* of the opening 312 is about from 1/16 to 1/8 length L4 of the lower base 316.

Figure 4:
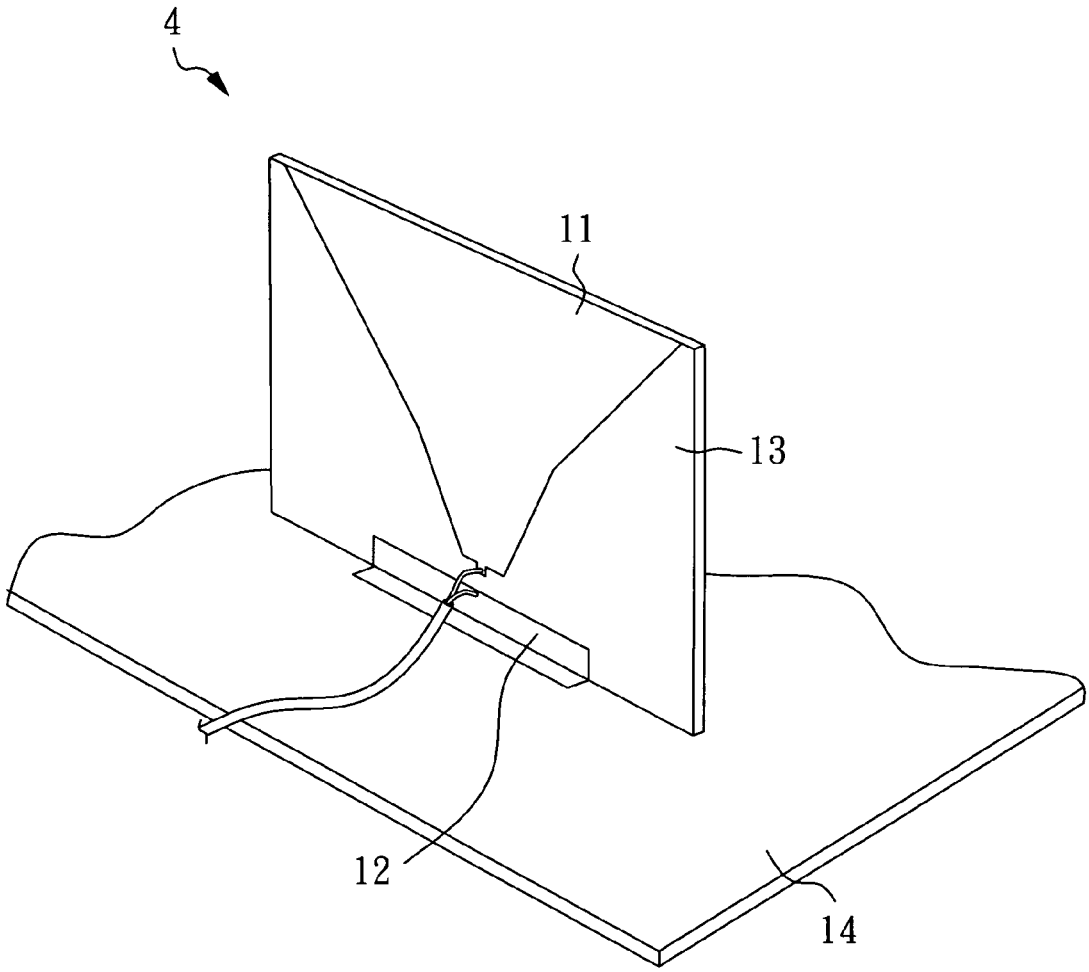
FIG. 4 is a perspective view of a broadband antenna of a further embodiment in accordance with the present invention.

Referring to FIG. 4, except utilizing the soldering part S, in an embodiment of a broadband antenna 4, the substrate 13 is connected with the reflector 14 by the second radiation element 12. And the first radiation element 11 of this embodiment is arranged opposite to that of the embodiment in FIG. 1A.

Figure 5:
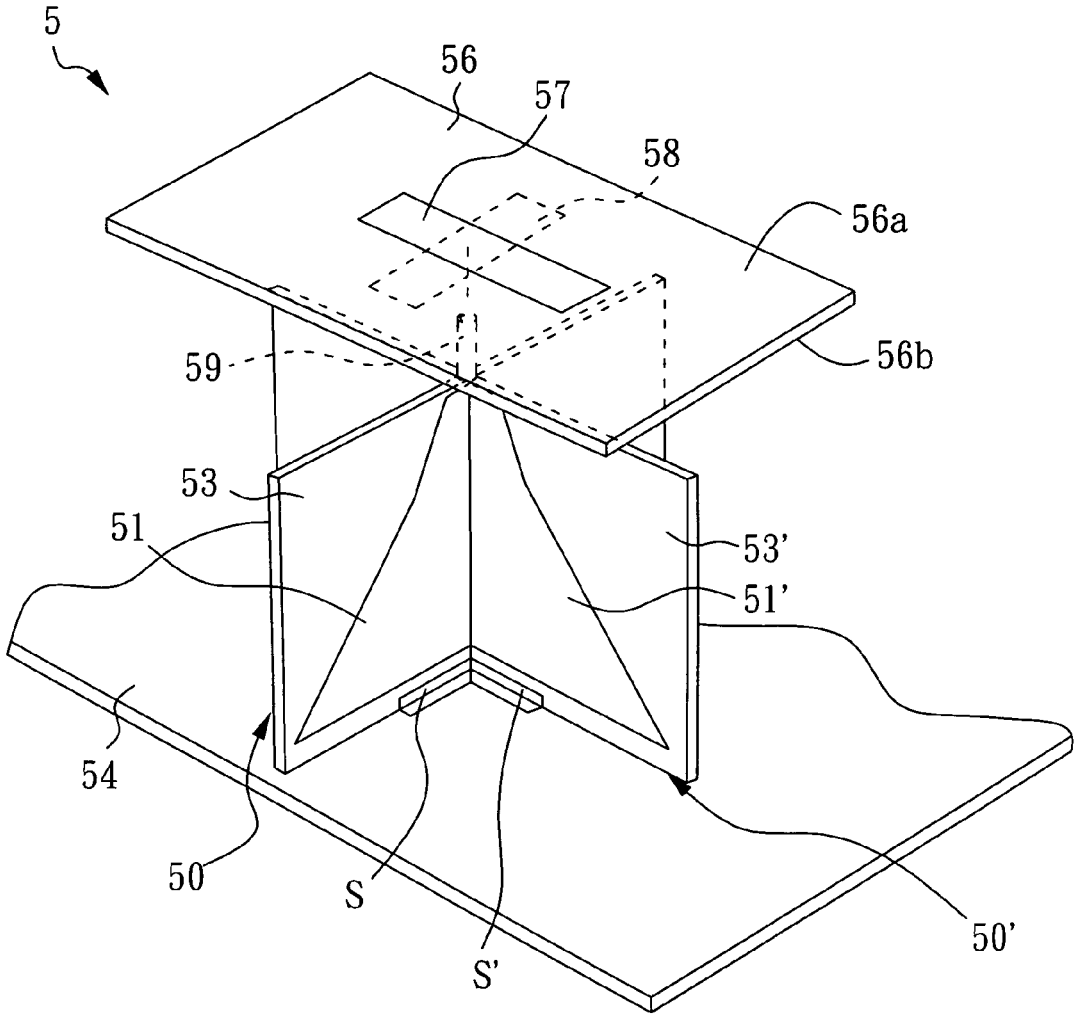
FIG. 5 is a perspective view of a broadband antenna assembly combination of an embodiment in accordance with the present invention.

Refer to FIG. 5, a broadband antenna assembly combination 5 is disclosed, which comprises of a first antenna 50, a second antenna 50', a radiation plate 56, and a reflector 54.

The first antenna 50 and/or the second antenna 50' respectively includes a first radiation element 51, 51' and a substrate 53, 53'. The substrate 53 of the first antenna 50 and the substrate 53' of the second antenna 50' intersect with each other at an angle such as 90 degrees. The radiation plate 56 is perpendicular to the substrate 53 of the first antenna 50 and the substrate 53' of the second antenna 50'. Moreover, the radiation plate 56 includes a third radiation element 57 and a fourth radiation element 58 that are disposed at a first side 56*a* and a second side 56*b* of the radiation plate 56 respectively. By current passing through the first radiation element 51 of the first antenna 50, the first radiation element 51' of the second antenna 50', and the third radiation element 57 as well as the fourth radiation element 58 of the radiation plate 56, radiation energy is excited and then reflected by the reflector 54.

Furthermore, the broadband antenna assembly combination 5 further includes a cable duct 59 that is disposed on an intersection of the substrate 53 of the first antenna 50 and the substrate 53' of the second antenna 50' and is extending to the radiation plate 56 for feeding current.

By a first soldering part S and a second soldering part S1, the reflector 54 is fixed with the substrate 53 of the first antenna 50 and the substrate 53' of the second antenna 50' by soldering respectively.

Figure 6:
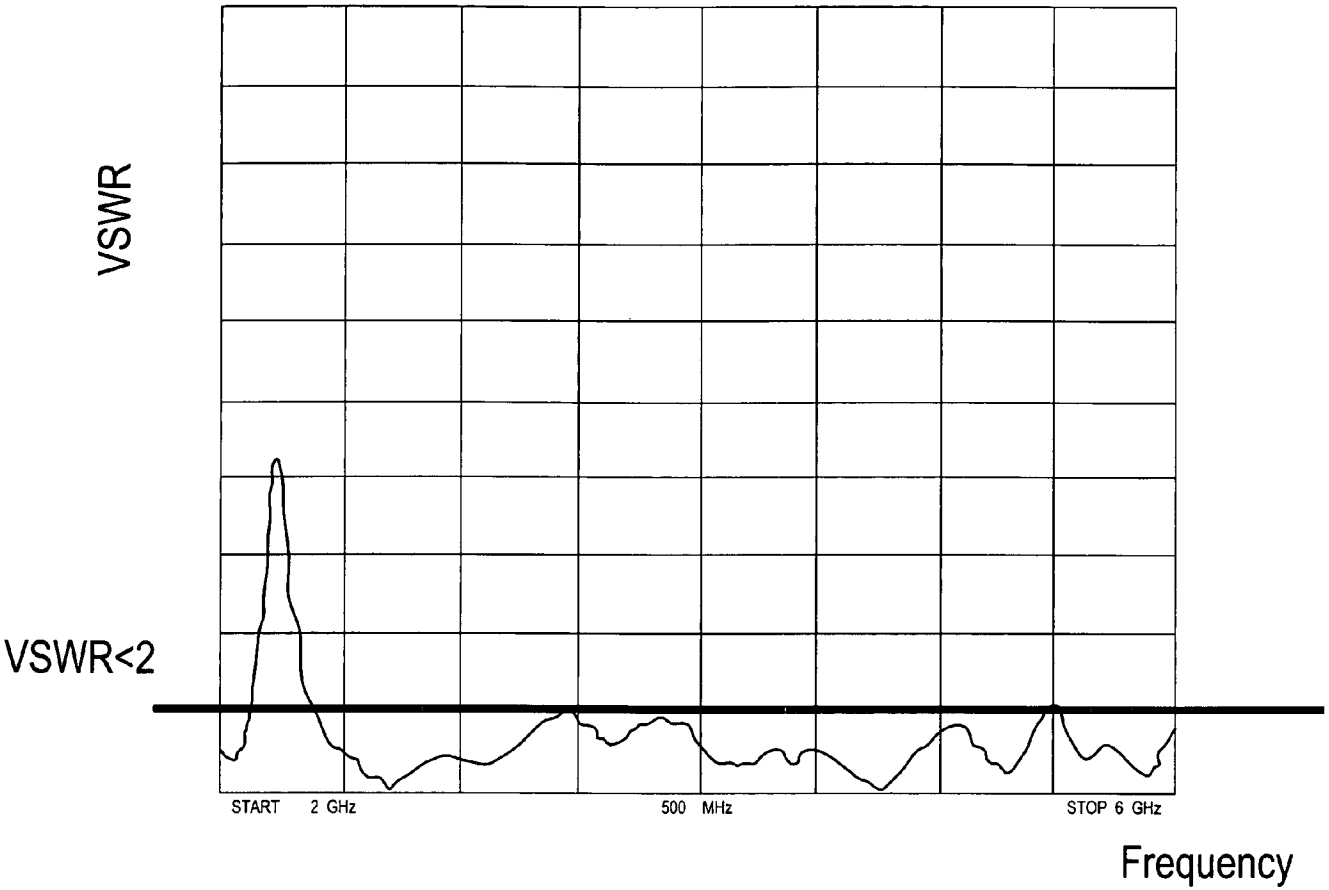
FIG. 6 shows Voltage Standing Wave Ratio (VSWR) of a broadband antenna of the embodiment in FIG. 1A at different frequencies.
Figure 7A:
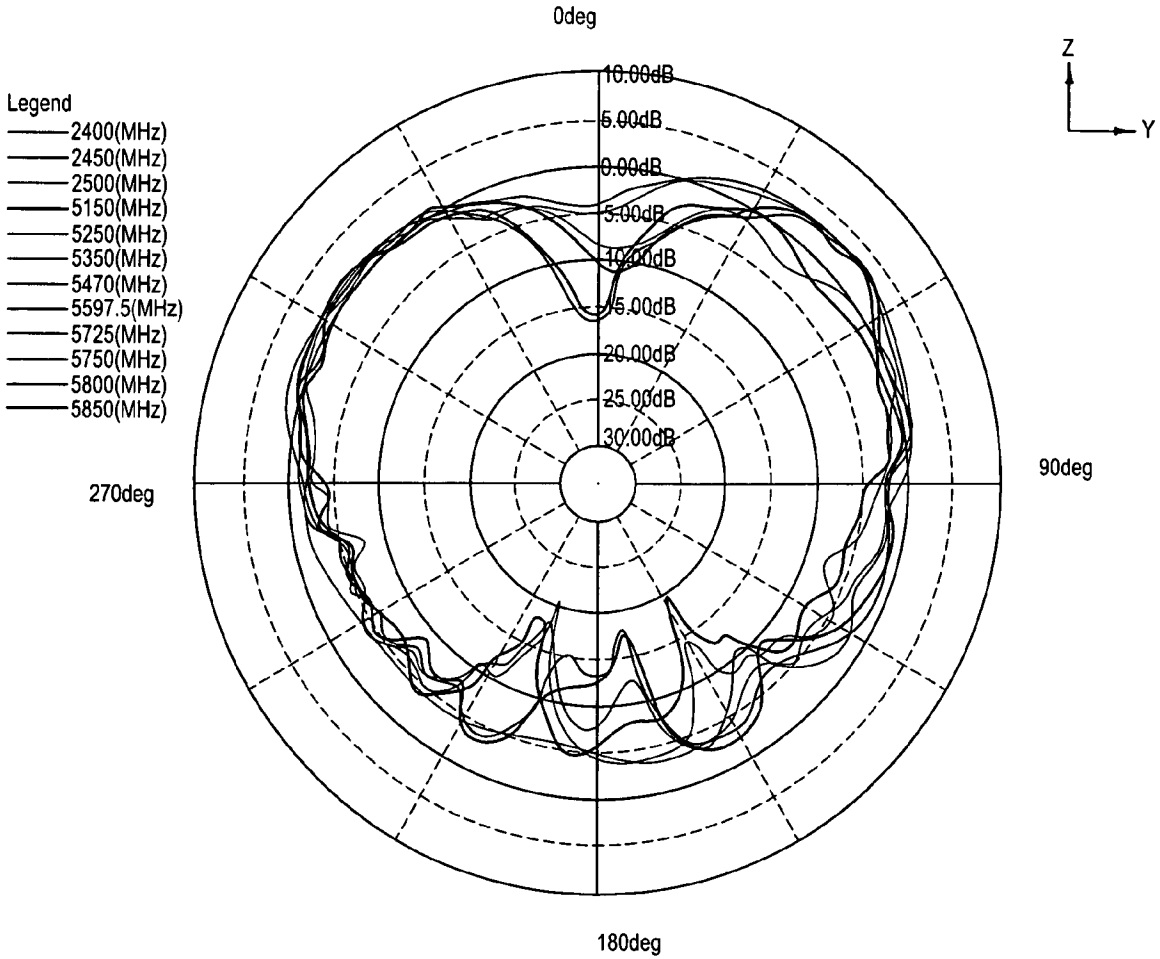
FIG. 7A and FIG. 7B respectively show the E-plane pattern and the H-plane pattern of a broadband antenna of the embodiment in FIG. 1A at different frequencies.
Figure 7B:
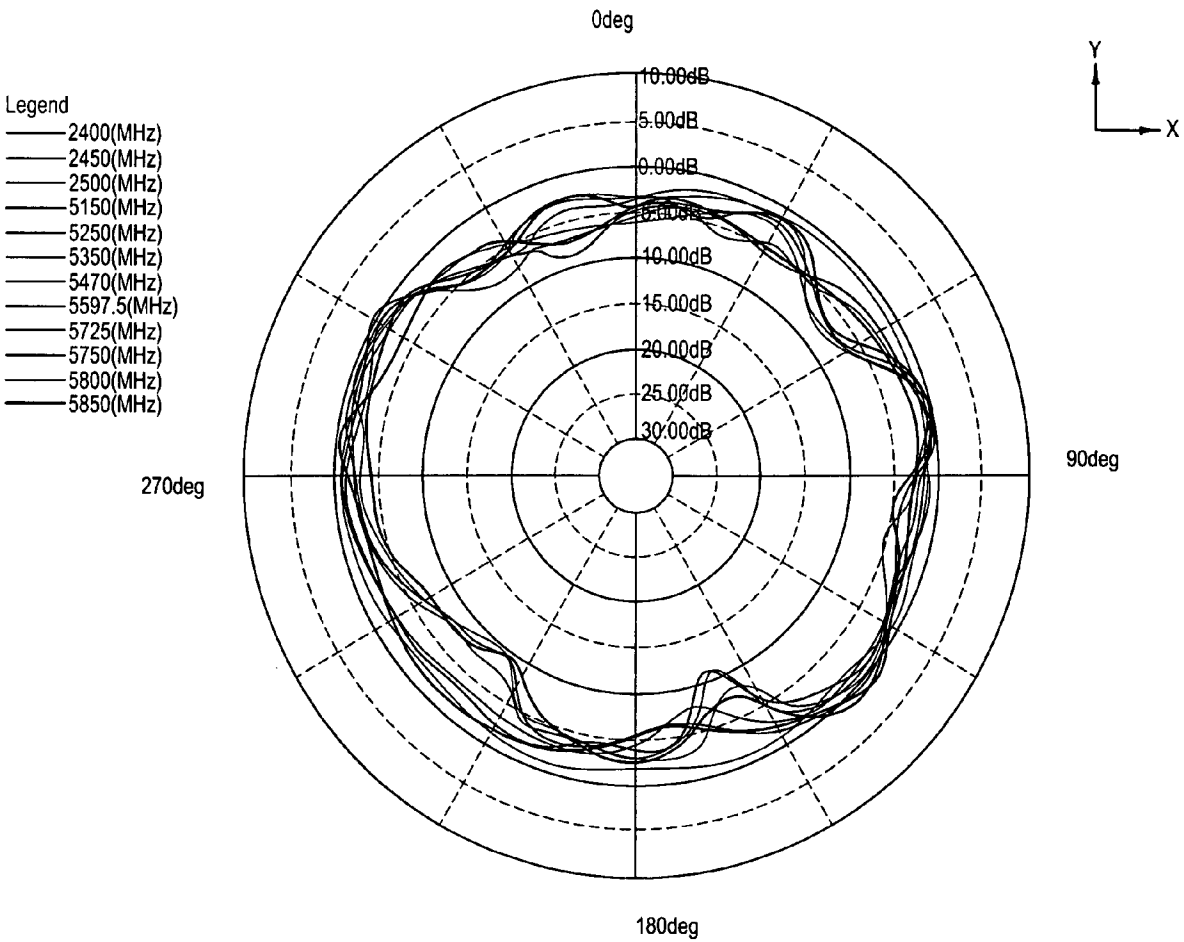
Figure 8:
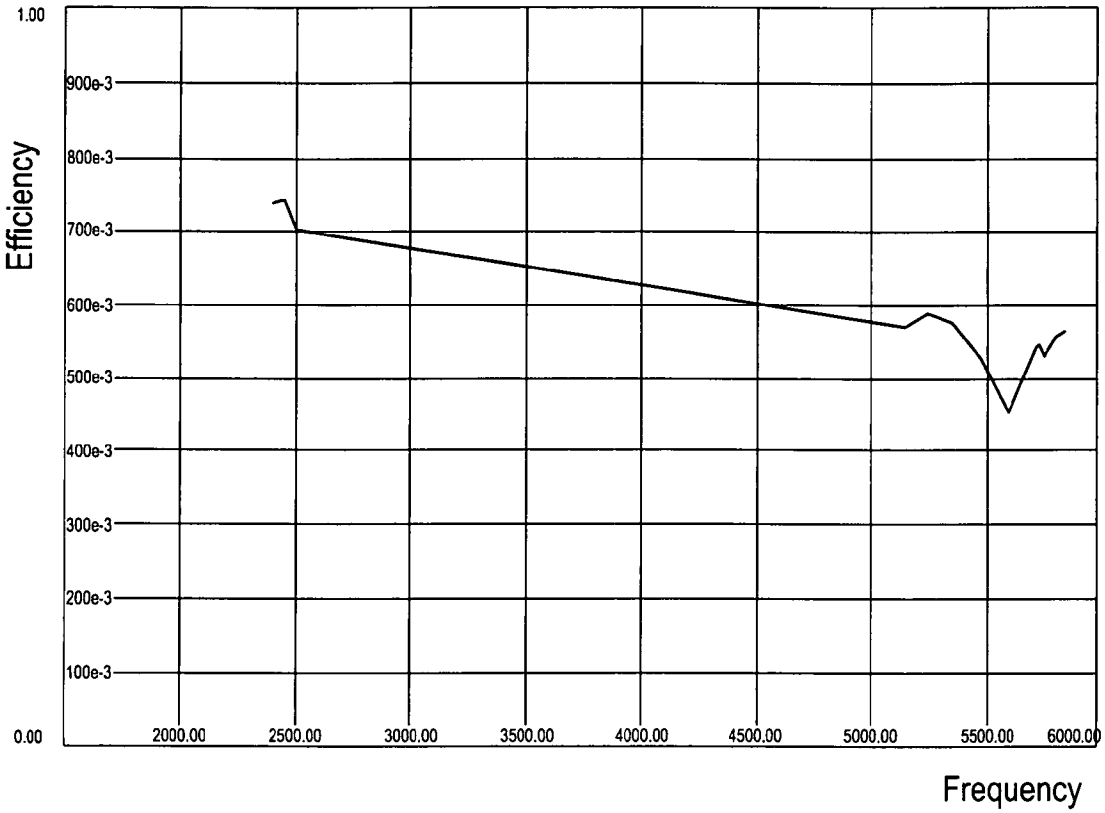
FIG. 8 shows efficiencies of a broadband antenna of the embodiment in FIG. 1A at different frequencies.

Referring to FIG. 6, it shows Voltage Standing Wave Ratio (VSWR) of the broadband antenna 1 in FIG. 1A at different frequencies. FIG. 7A shows the E-plane pattern at different frequencies while FIG. 7B shows the H-plane pattern at different frequencies. FIG. 8 shows efficiency of the broadband antenna 1 in FIG. 1A at different frequencies.

Figure 9:
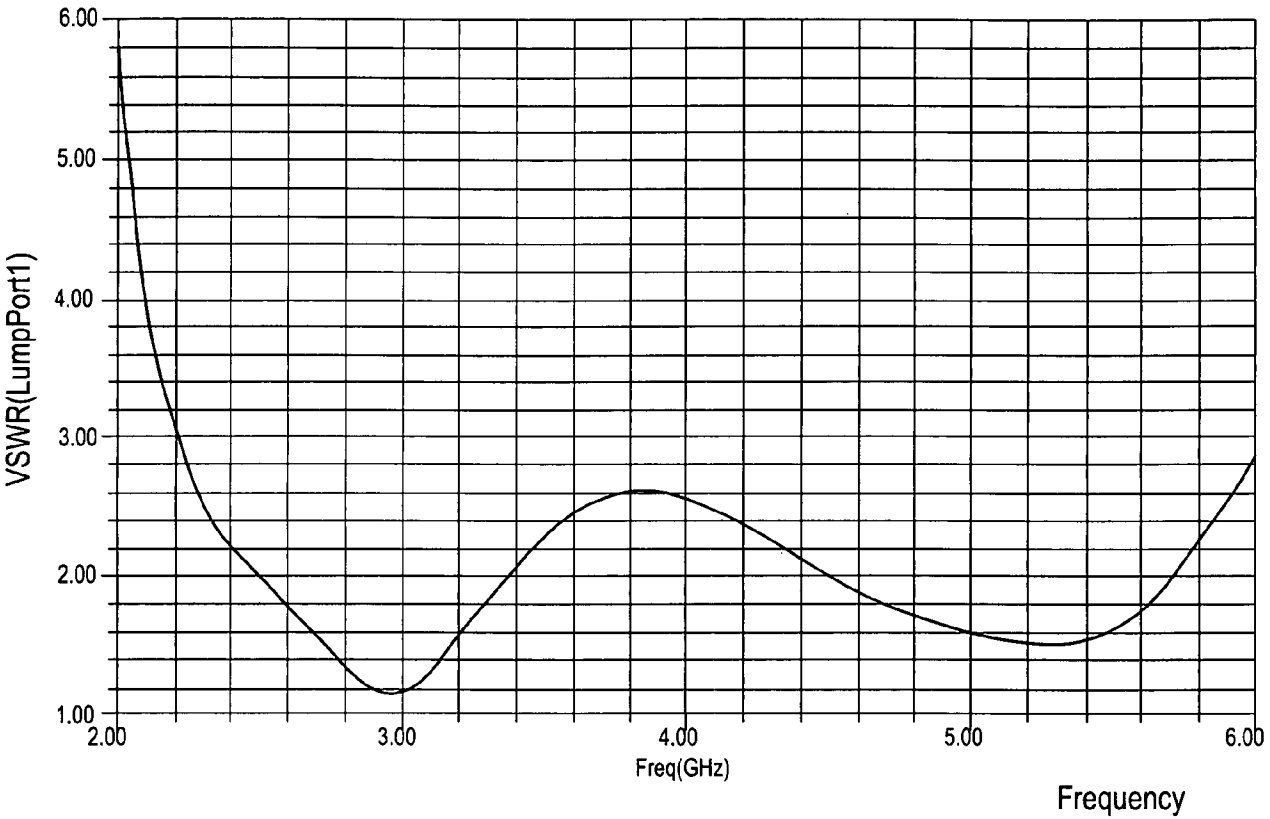
FIG. 9 shows Voltage Standing Wave Ratio (VSWR) of a broadband antenna of the embodiment in FIG. 3A detected at different frequencies.
Figure 10A:
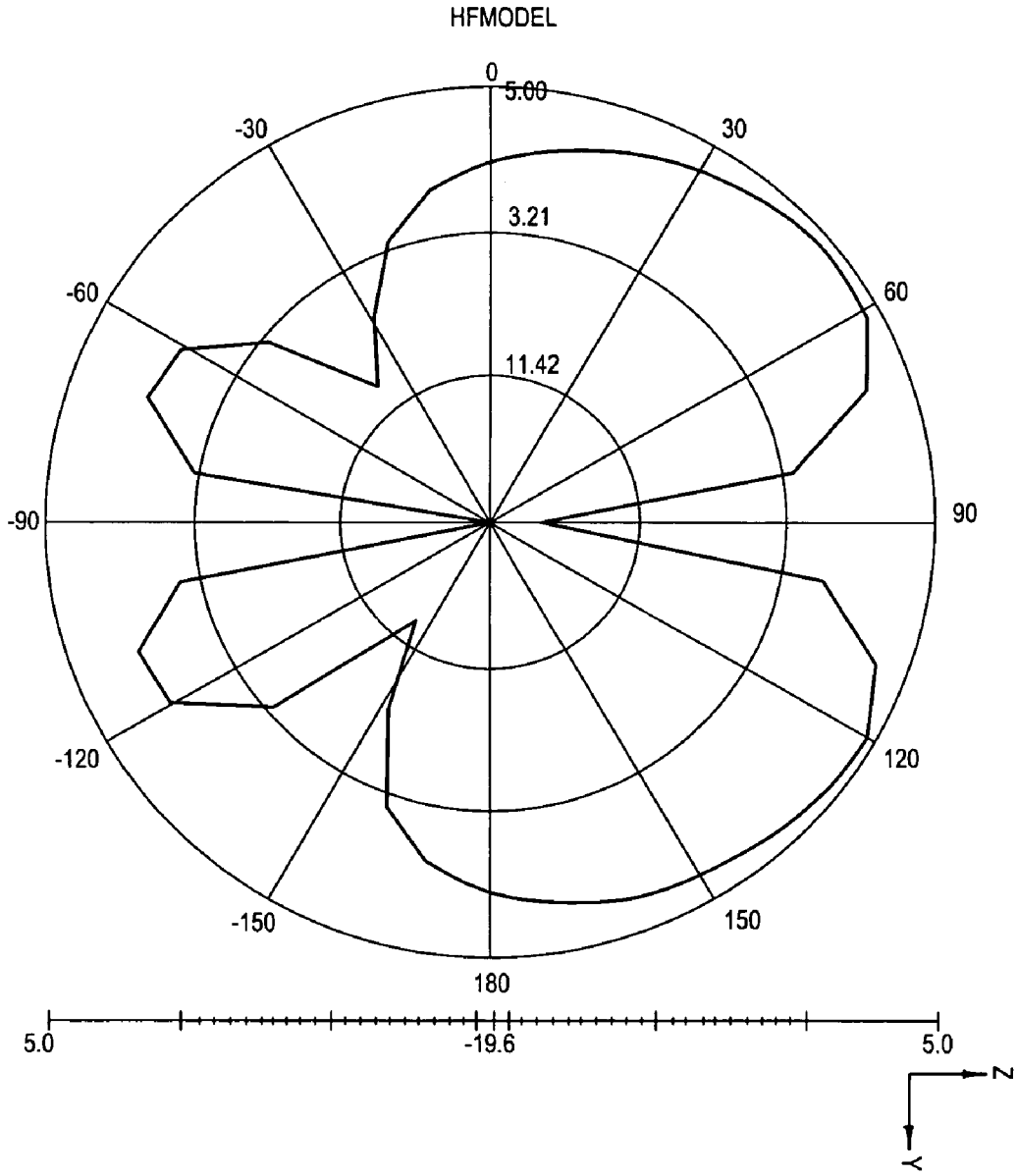
FIG. 10A and FIG. 10B show the E-plane pattern of a broadband antenna of the embodiment in FIG. 3A at 2.5 GHz (low frequency) and at 5.25 GHz (high frequency) respectively.
Figure 10B:
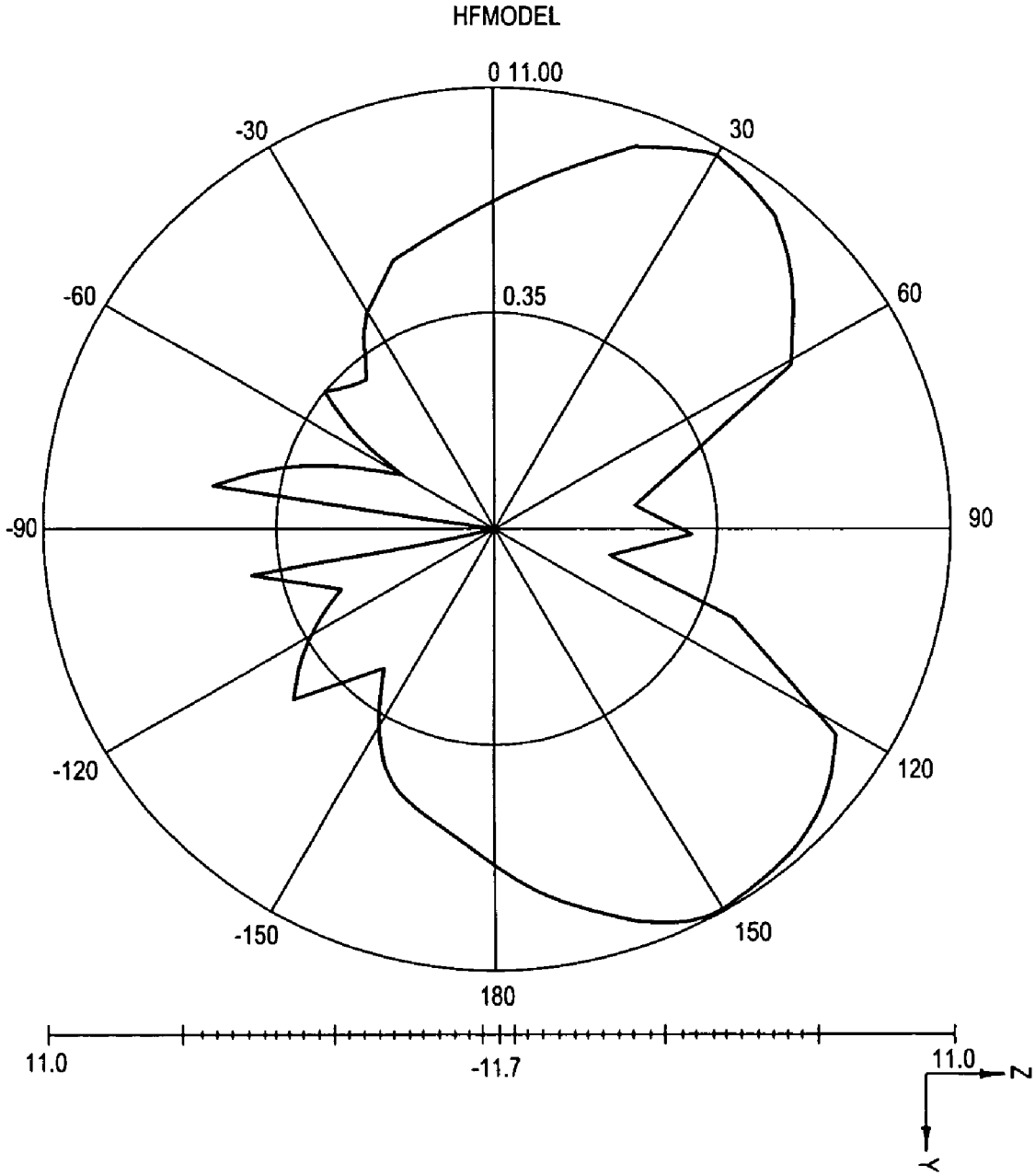

Referring to FIG. 9, it shows Voltage Standing Wave Ratio (VSWR) of the broadband antenna 3 in FIG. 3A at different frequencies. FIG. 10A and FIG. 10B respectively show the E-plane pattern at 2.5 GHz (low frequency) and at 5.25 GHz (high frequency).

Figure 11:
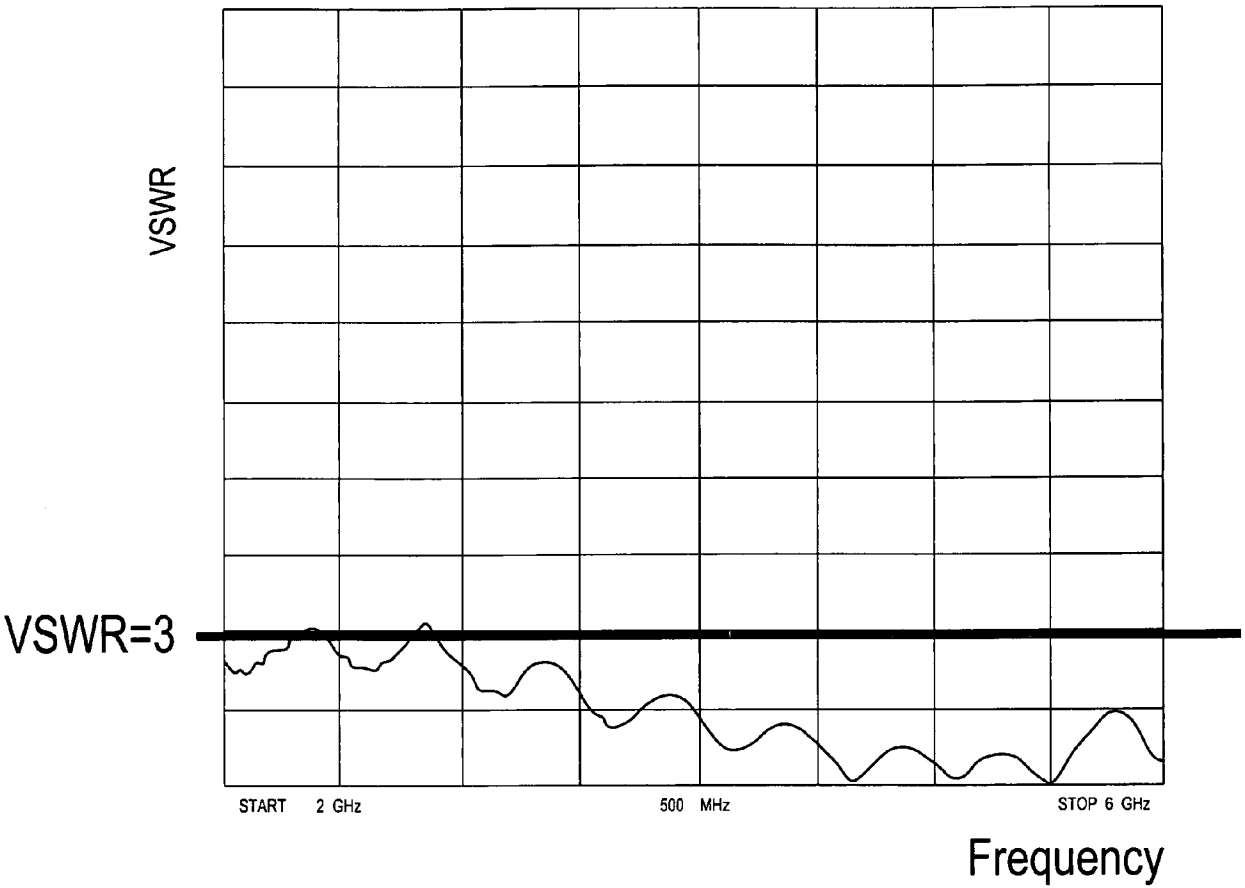
FIG. 11 shows Voltage Standing Wave Ratio (VSWR) of a broadband antenna of the embodiment in FIG. 4 at different frequencies.

Referring to FIG. 11, it shows Voltage Standing Wave Ratio (VSWR) of the broadband antenna 4 in FIG. 4 at different frequencies.

In accordance with above embodiments, it should be noted that by adjusting width, length, angle and distance of the radiation element such as parameter W1, L1, L1*a*, L1*b*, L4, L4*a*, L4*b*, L4*c*, D1, D2, θ, θ1, θ2 mentioned above, a better impedance match can be achieved. Moreover, the radiation pattern can be controlled in accordance with different shapes of the radiation elements.

Furthermore, the positions of the elements mentioned above can be varied, as skilled persons in this art will be appreciated. For example, as the second radiation element 22 shown in FIG. 2B is n-shaped, but not limited to. It can also be U-shaped. That means the second part 222 is on above the first part 221 (not shown in figures).

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A broadband antenna comprising:

a first radiation element having a first trapezoid portion and a second trapezoid portion, the first trapezoid portion being adjacent to the second trapezoid portion to form an integral; the first trapezoid portion and the second trapezoid portion including an upper base and a lower base, respectively, wherein a length of the lower base of the first trapezoid portion is substantially equal to a length of the upper base of the second trapezoid portion while a length of the lower base of the second trapezoid portion is larger than a length of the lower base of the first trapezoid portion;

a second radiation element;

a substrate for disposing the first radiation element and the second radiation element thereon; and a reflector for fixing the substrate and reflecting energy radiated from the first radiation element and the second radiation element through current excitation.

2. The broadband antenna as claimed in claim 1, wherein the first radiation element further comprises a second trapezoid portion, and the first trapezoid portion is adjacent to the second trapezoid portion to form an integral; the first trapezoid portion and the second trapezoid portion include an upper base and a lower base, respectively, wherein a length of the lower base of the first trapezoid portion is substantially equal to a length of the upper base of the second trapezoid portion while a length of the lower base of the second trapezoid portion is larger than a length of the lower base of the first trapezoid portion.

3. The broadband antenna as claimed in claim 1, wherein the broadband antenna further comprises a coaxial cable electrically connecting to the first radiation element and to the second radiation element for feeding current for the first radiation element and the second radiation element.

4. The broadband antenna as claimed in claim 1, wherein the first radiation element and the second radiation element respectively comprise a first feeding point and a second feeding point.

5. The broadband antenna as claimed in claim 4, wherein the first feeding point is located at a midpoint of the upper base of the first trapezoid portion of the first radiation element, and the second feeding point is located at a midpoint of the second radiation element.

6. The broadband antenna as claimed in claim 4, wherein the first radiation element comprises a feeding part substantially protruding from the upper base of the first trapezoid portion.

7. The broadband antenna as claimed in claim 1, wherein the first trapezoid portion further comprises two legs having an intersection angle between 50 to 80 degrees.

8. The broadband antenna as claimed in claim 1, wherein the second trapezoid portion further comprises two legs, while absolute values of slopes of the two legs of the first trapezoid is larger than or substantially equal to absolute values of slopes of the two legs of the second trapezoid portion, respectively.

9. The broadband antenna as claimed in claim 8, wherein the absolute values of the slopes of the two legs of the first trapezoid portion is larger than or substantially equal to the absolute values of the slopes of the two legs of the second trapezoid portion between 0 to 20 degrees.

10. The broadband antenna as claimed in claim 1, wherein a distance between the first radiation element and the second radiation element is smaller than or substantially equal to 5 millimeter (mm).

11. The broadband antenna as claimed in claim 1, wherein a length of the second radiation element is larger than or substantially equal to ¼ wavelength of the center frequency at low frequency band.

12. The broadband antenna as claimed in claim 1, wherein a width of the second radiation element is smaller than or substantially equal to 1/16 wavelength of the center frequency at low frequency band.

13. The broadband antenna as claimed in claim 1, wherein the second radiation element comprises a first part, a second part, and a connecting part connecting the first part and the second part; while the first part is n-shaped and a width of the first part is smaller than or substantially equal to 1/16 wavelength of the center frequency at low frequency band.

14. The broadband antenna as claimed in claim 13, wherein the first radiation element and the second radiation element comprise a first feeding point and a second feeding point respectively.

15. The broadband antenna as claimed in claim 14, wherein the first feeding point is located at a midpoint of the upper base of the first trapezoid portion of the first radiation element, and the second feeding point is located at a midpoint of the second part of the second radiation element.

16. The broadband antenna as claimed in claim 13, wherein a total length of the first part and the second part is substantially about ¼ wavelength of the center frequency at low frequency band, and a length of the second part is substantially about ¼ wavelength of the center frequency at high frequency band.

17. The broadband antenna as claimed in claim 1, wherein the reflector and the substrate is fixed with each other by a soldering part.

18. The broadband antenna as claimed in claim 1, wherein the substrate and the reflector is fixed with each other by the second radiation element.

19. The broadband antenna as claimed in claim 1, wherein the substrate is disposed perpendicular to the reflector.

20. The broadband antenna as claimed in claim 17, wherein a distance between the first radiation element and the soldering part is larger than or substantially equal to 0.3 millimeter (mm).

21. A broadband antenna comprising:

a first radiation element having an upper base, a lower base and two legs that connect the upper base and the lower base while a length of the lower base of the first radiation element is substantially equal to a length of the upper base thereof;

a second radiation element;

a substrate for disposing the first radiation element and the second radiation element thereon; and a reflector for fixing the substrate and reflecting energy radiated from the first radiation element and the second radiation element through current excitation.

22. The broadband antenna as claimed in claim 21, wherein the lower base of the first radiation element having an opening.

23. The broadband antenna as claimed in claim 21, wherein the length of the upper base is substantially ¼ wavelength of the center frequency at high frequency band.

24. The broadband antenna as claimed in claim 21, wherein a width of the two legs is substantially from 1/16 to ⅛ length of the lower base.

25. The broadband antenna as claimed in claim 22, wherein a length of the opening is substantially from 1/16 to ⅛ length of the lower base.

26. A broadband antenna assembly combination comprising:

a first antenna and a second antenna respectively having a substrate and a first radiation element disposed on the substrate, wherein the first radiation element of the first antenna or the second antenna is substantially shaped in trapezoid, while the substrate of the first antenna and the substrate of the second antenna intersect with each other;

a radiation plate comprising a first side, a second side corresponding to the first side, a third radiation element disposed on the first side, and a fourth radiation element disposed on the second side, wherein the radiation plate is disposed perpendicular to the substrate of the first antenna and to the substrate of the second antenna; and a reflector disposed parallel to the radiation plate with the first antenna and the second antenna being fixed thereon so that the first antenna and the second antenna are located between the reflector and the radiation plate, wherein the first radiation element of the first antenna, the first radiation element of the second antenna, the third radiation element, and the fourth radiation element are excited for radiation energy reflected by the reflector.

27. The broadband antenna assembly combination as claimed in claim 26, further comprising a cable duct disposed on an intersection of the substrate of the first antenna and the substrate of the second antenna and extending to the radiation plate for feeding current into the third radiation element and the fourth radiation element.

28. The broadband antenna assembly combination as claimed in claim 26, wherein the reflector is connected with the substrate of the first antenna and the substrate of the second antenna by a first soldering part and a second soldering part respectively.

* * * * *